United States Patent [19]

Bishop

[11] 4,101,111

[45] Jul. 18, 1978

[54] BLOCK AND BRACE ASSEMBLY

[76] Inventor: Byron Norman Bishop, 4121 Casa Loma, Yorba Linda, Calif. 92686

[21] Appl. No.: 772,648

[22] Filed: Feb. 28, 1977

Related U.S. Application Data

[63] Continuation-in-part of Ser. No. 747,157, Dec. 3, 1976, abandoned.

[51] Int. Cl.[2] ..... B28B 17/00

[52] U.S. Cl. ..... 249/205; 248/351; 249/219 R

[58] Field of Search ..... 248/351; 249/3–7, 249/13, 18, 34, 163, 205, 207, 208, 210, 219 R

[56] References Cited

U.S. PATENT DOCUMENTS

| | | | |
|---|---|---|---|
| 870,948 | 11/1907 | Fuchs | 248/351 |
| 1,512,165 | 10/1924 | Funkhouser | 249/6 |
| 1,682,008 | 8/1928 | Heltzel | 249/205 |
| 1,722,144 | 7/1929 | Heltzel | 249/205 |
| 3,817,006 | 6/1974 | Williams | 248/354 R |

*Primary Examiner*—Francis S. Husar
*Assistant Examiner*—John McQuade
*Attorney, Agent, or Firm*—Morland Charles Fischer

[57] ABSTRACT

An effective, low cost block and brace assembly having utility in the art of tilt-up construction. In the assembled relationship, the block and brace form a right triangle to provide maximum support for a mold form during the pouring of concrete and the subsequent formation of a precast panel.

20 Claims, 13 Drawing Figures

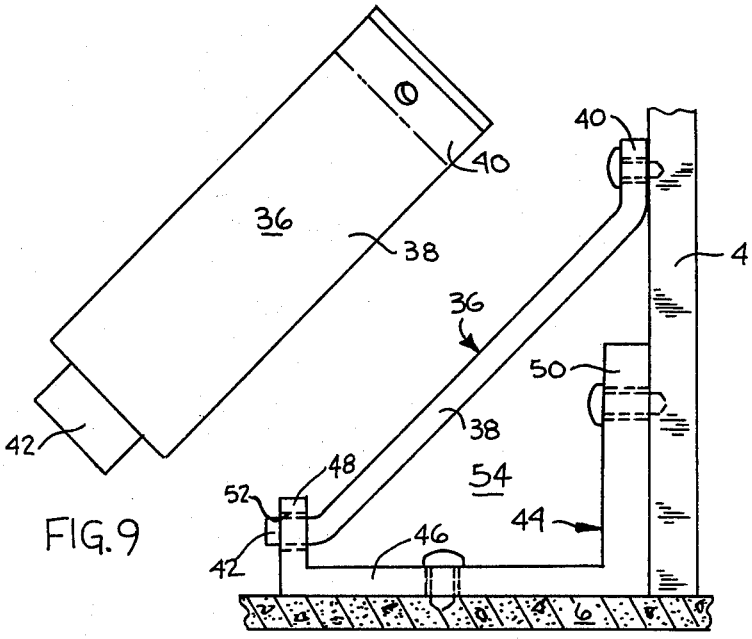
FIG. 9
FIG. 11
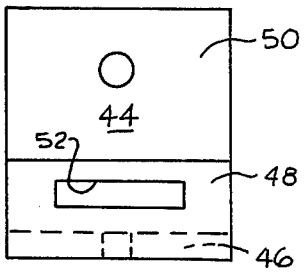
FIG. 10
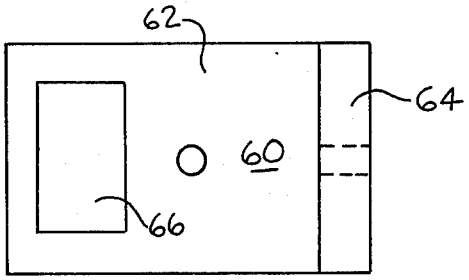
FIG. 12
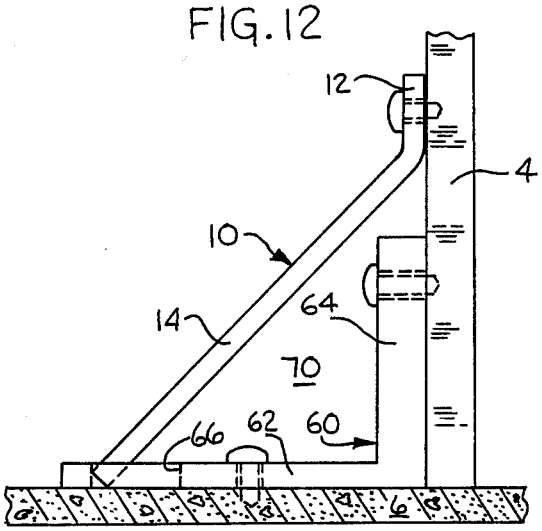
FIG. 13

BLOCK AND BRACE ASSEMBLY

CROSS REFERENCES TO RELATED PATENT APPLICATIONS

This patent application is a continuation-in-part of U.S. Ser. No. 747,197 filed Dec. 3, 1976, and now abandoned.

BACKGROUND OF THE INVENTION

1. Field of the Invention

This invention relates to a block and brace arrangement having particular application to the formation of concrete panels which are common to the art of tilt-up construction.

2. Prior Art

It is well known to one engaged in the art of tilt-up construction to utilize a conventional wooden block and cleat during the process of forming a precast concrete panel. Typically, concrete is poured over a casting pad and into a mold form having the dimensions of the desired panel. After a suitable hardening period has elapsed, the mold form is removed. Upon the termination of additional curing time (generally about 7 days), a finished concrete panel can be lifted off the casting pad and properly positioned at a construction site by means of a crane or the like.

The aforementioned mold form normally consists of a plurality of interconnected two-by-six, two-by-eight, etc., pieces of lumber. Structural support for the mold form during the pouring and formation of the concrete panel is provided by the conventional wooden block and plywood cleat assembly. As known to those skilled in the art, the block and cleat arrangement is highly inefficient, inasmuch as extensive labor is required to form the assembly. More particularly, wood must be stripped, cleaned and cut to form the block. The block and cleat are interconnected by means of nails, thereby resulting in an undesirable hazard of protruding nails. Moreover, after the formation of only a relatively few assemblies, the conventional block and cleat are usually discarded, because they are ultimately destroyed with continued use. This undesirably increases both waste and the corresponding cost incurred during the tilt-up construction process.

Other examples of the prior art are shown in the following patents: U.S. Pat. No. 1,690,295, Nov. 6, 1928; U.S. Pat. No. 2,246,960, June 24, 1941; U.S. Pat. No. 3,144,700, Aug. 18, 1964; U.S. Pat. No. 3,817,006, June 18, 1974.

SUMMARY OF THE INVENTION

Briefly, and in general terms, a block and brace assembly is disclosed having particular utility in the art of tilt-up construction for fabricating precast, portable concrete panels. The instant block and brace assembly is more efficient and provides greater support than a conventional block and cleat arrangement.

The brace member consists of a flat plate having first and second ends. The first end of the brace member turns upward from the flat plate and is adapted to be connected to the outside of a mold form, into which concrete is poured to form the panel. The block member consists of a flat plate having at least one end thereof, which end turns in an upward direction to form an angle of substantially 90° relative to the respective flat plate. This first upturned end of the block member is also adapted to be secured to the outside of the mold form. The block member includes a second end, which second end is provided with means by which to receive and engage the corresponding second end of the flat plate which comprises the brace member. In a preferred embodiment, the first upturned end of the brace member is connected to the mold form at a point above the connection of the first upturned end of the block member to the mold form. Hence, in the assembled relationship the block and brace members form a right triangle to maximize the lateral support given to the mold form during the subsequent formation of the concrete panel.

BRIEF DESCRIPTION OF THE DRAWINGS

FIG. 9 is a top view of the brace member which forms a third preferred embodiment.

FIG. 10 is an end view of the block member which forms the third embodiment.

FIG. 11 is a side view of the block and brace members which comprise the third embodiment of the instant invention in the assembled relationship.

FIG. 12 is a top view of the block member which forms a fourth preferred embodiment.

FIG. 13 is a side view of the block and brace members which comprise the fourth embodiment of the instant invention in the assembled relationship.

DESCRIPTION OF THE PREFERRED EMBODIMENTS

Figure 2:
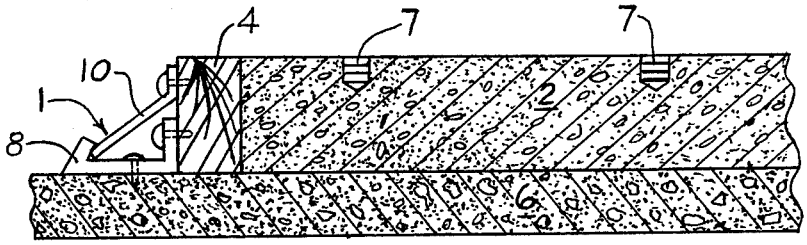
FIG. 2 is a cross section taken along lines 2—2 of FIG. 1.
Figure 1:
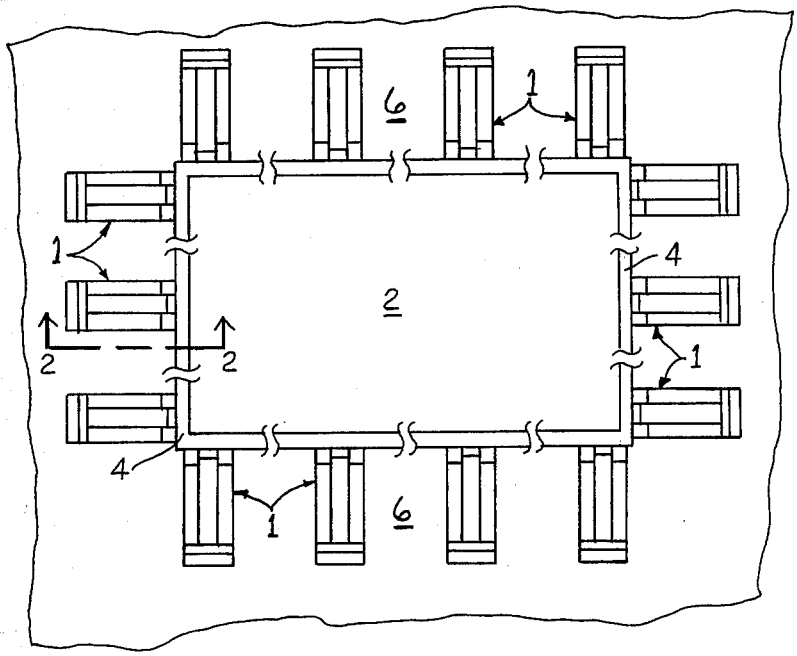
FIG. 1 shows the presently disclosed block and brace arrangement employed in the art of tilt-up construction.

Referring concurrently to FIGS. 1 and 2, the block and brace assembly 1 of the present invention is illustrated, as applied, in a preferred embodiment, to the formation of a concrete panel 2. Such concrete panels 2 are utilized by those skilled in the art of tilt-up construction. Each concrete panel 2 is cast in a well-known mold form 4. The mold form 4 typically consists of a plurality of pieces of lumber which are sized and interconnected to achieve the configuration of the desired concrete panel. The mold form 4 is attached to an elongated casting pad 6. Casting pad 6 is fabricated from a non-porous, hard material such as concrete, asphalt, earth or the like. The top surface of casting pad 6 is covered with an anti-sticking material to prevent concrete panel 2 from adhering to the casting pad 6. Concrete (or any other suitable material) is subsequently poured into the mold form 4 and allowed to harden, so that after appropriate curing time (typically 1 to 7 days) has elapsed, the block and brace assembly 1 and the mold form 4 may be removed. The finished concrete panel 2 is then ready to be lifted at threaded pick-up points 7 and removed to a desired construction site by means of a crane or the like.

To lend adequate support to the mold form 4 during the pouring of the concrete and the subsequent formation of the panel 2, a plurality of block and brace assemblies 1 of the present invention are connected between the mold form 4 and the casting pad 6. Generally, and as best shown in FIG. 1, block and brace assemblies 1 are disposed at convenient three foot intervals around the outside perimeter of the mold form 4. One end of the block member 8 of assembly 1 is attached to the casting pad 6 by means of nails, pins or dowels. The other end of block member 8 is nailed to the mold form 4. One end of the brace member 10 of assembly 1 is nailed to the mold form 4. As will be disclosed in greater detail hereinafter, the second end of brace member 10 is adapted to be received by an arm of block member 8.

Figure 3:
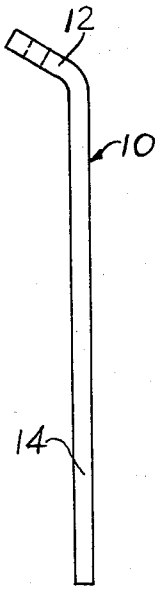
FIGS. 3–5 show detailed illustrations of the block and brace members which comprise a preferred embodiment of the instant invention.
Figure 4:
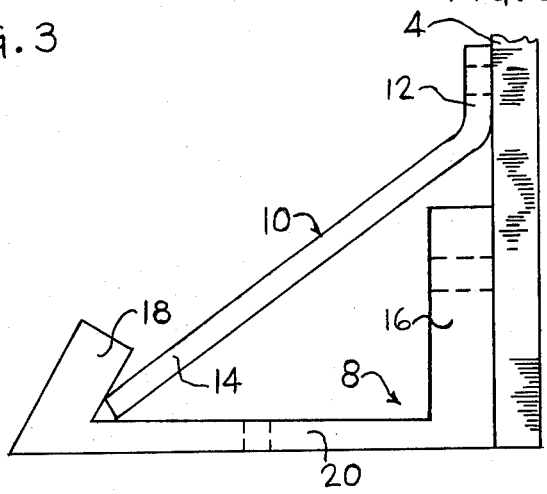
Figure 5:
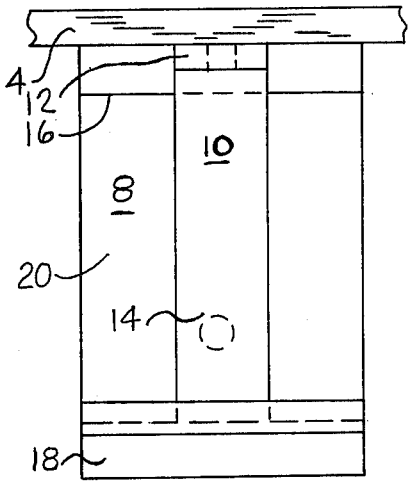

In accordance with the instant invention, FIGS. 3–5 show detailed illustrations for a first preferred embodiment of the presently disclosed block and brace assembly. The brace member 10, best shown in FIG. 3, comprises a flat plate portion (e.g., rolled steel, aluminum or the like) having first 12 and second 14 ends thereof. The first end 12 of the brace member 10 turns upwards from the flat plate portion. This upturned first end 12 of brace member 10 includes a suitable number of screwholes, or the like, and is adapted (as best shown in FIGS. 4 and 5) to be securely connected to the outside of mold form 4. The second end 14 of brace member 10 may be either squared or rounded off in order to be conveniently received by an arm of the block member 8.

In FIGS. 4 and 5, the block 8 and brace 10 are shown in the assembled relationship to provide the required support to mold form 4. Block member 8 is also from a suitable flat plate portion 20 (e.g., rolled steel, aluminum or the like). However, the block member may also be a portion of extruded channel of suitable dimension. The flat plate portion 20 which comprises block member 8 has first 16 and second 18 ends thereof. The first end 16 of block member 8 turns up at an angle of substantially 90° with respect to the flat plate portion 20. This first end 16 of block member 8 includes a suitable number of screwholes, or the like, and is adapted to be securely connected to the outside of the mold form 4. The second end 18 of block member 8 also turns upward, but at an angle of less than 90° with respect to the flat plate portion 20 so as to form a suitable receiving and retaining arm for the second end 14 of brace member 10 and to thereby prevent the brace from running up the second end 18 of block member 8. The flat plate portion 20 of block member 8 also includes a suitable number of screwholes, or the like, so as to be securely connected to the casting pad, as previously disclosed.

The height of the first upturned end 16 of block member 8 is greater than that of the second upturned end 18. This extension of the first end 16 of block member 8 enables the block and brace assembly of the present invention to form a triangle in order to provide maximum support for mold form 4. That is, the first end 16 and the flat plate portion 20 of block member 8 form the sides of a right triangle. The second end 14 of brace member 10, which is longer than either of the first end 16 or the flat plate portion 20 of block member 8 comprises the hypotenuse of the right triangle. The upturned end 12 of brace member 10 is connected to the mold form 4 at a point above the corresponding connection of the block member first end 16 to mold form 4. The brace member 12 provides additional structural support for the assembly.

Figure 6:
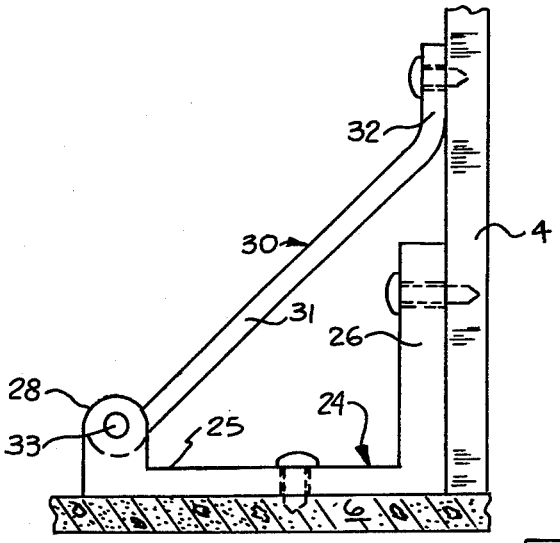
FIG. 6 shows a side view of the block and brace members which form a second preferred embodiment arranged in the assembled relationship.
Figure 7:
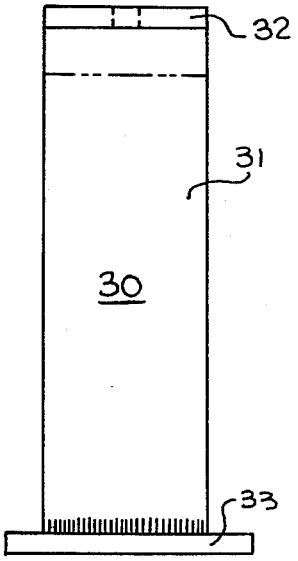
FIG. 7 is a top view of the brace member which forms the second embodiment.
Figure 8:
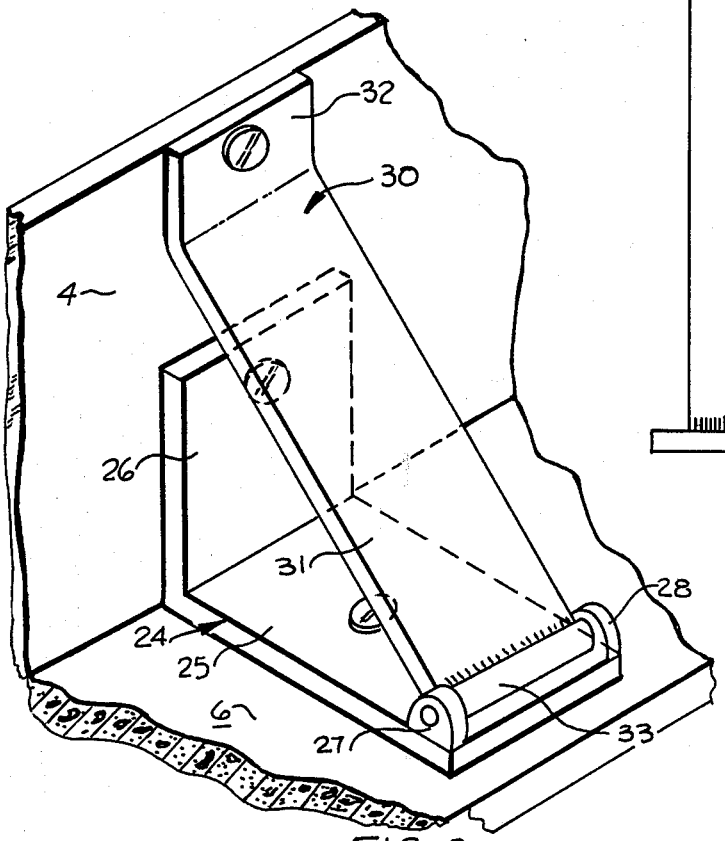
FIG. 8 is a perspective view of the block and brace members which comprise the second embodiment of the instant invention in the assembled relationship.

FIGS. 6–8 show a second preferred embodiment for the block and brace assembly of the present invention. More particularly, and as best shown in FIG. 7, the brace member 30 is comprised of a flat plate portion 31. A first end 32 of the brace member 30 includes a suitable number of screwholes, or the like, and turns in an upward direction from the flat plate portion 31, whereby the brace member 30 is adapted to be securely connected to the outside of the mold form 4. A second end of the brace member 30 includes an elongated rod or pin 33. The rod 33 is attached to the second end of the brace member 30 by any suitable means, such as, for example, by welding.

FIGS. 6 and 8 show the block and brace members 24 and 30 arranged in the assembled relationship. The block member 24 is comprised of a flat plate portion 25. A first end 26 of the block member 24 turns in an upward direction to form an angle of substantially 90° with respect to the flat plate portion 25. The first end 26 and the flat plate portion 25 of the block member 24 each contain a suitable number of screwholes, or the like, to enable the block member to be securely connected to the outside of the mold form 4 and to the casting pad 6. The flat plate portion 25 of the block member 24 includes a pair of conveniently spaced, hollow sleeves 27 and 28. As best illustrated in FIG. 8, the first sleeve 27 is attached to the flat plate portion 25 by suitable means, such as, for example, by welding. One end of the rod 33, which is connected to the brace member 30, is inserted through the sleeve 27. The second end of the rod 33 is then inserted through the second sleeve 28 of the pair of sleeves, and the second sleeve 28 is attached to the flat plate portion 25 of the block member 24. Hence, the rod 33 is received by the sleeves 27 and 28, whereby the brace member 30 is connected to the block member 24, thereby resulting in a reliable and economical one-piece assembly. What is more, the brace member 30 is adapted to pivot to any desired position about the axis formed by the rod 33 in order to move into or out of contact with the mold form 4.

As best shown in FIG. 6, the first upturned end 32 of the brace member 30 is connected to the mold form 4 at a point above the corresponding connection of the first upturned end 26 of the block member 24 to the mold form 4. Thus, when arranged in the assembled relationship, the block and brace members 24 and 30 form a right triangle to provide maximum upper and lower lateral support to the mold form 4. That is, the first upturned end 26 and the flat plate portion 25, which comprise the block member 24, form the sides of the right triangle. The flat plate portion 31, which comprises the brace assembly 30, forms the hypotenuse of the right triangle.

FIGS. 9–11 show another preferred embodiment for the block and brace assembly 54 of the present invention. More particularly, FIG. 9 shows a top view of the brace member 36. The brace member 36 is comprised of a flat plate portion 38 having first 40 and second 42 ends thereof. As best illustrated in FIG. 11, the first end 40 of the brace member 36 includes a suitable number of screwholes, or the like, and turns in an upward direction from the flat plate portion 38, whereby the brace member 36 is adapted to be securely connected to the outside of the mold form, when arranged in the assembled relationship with the block member 44. The second end 42 of the brace member 36 may consist of a tab portion. That is, the second end tab 42 of the brace member 36 is fabricated to have a width that is smaller in dimension than that of the flat plate portion 38. As is also best illustrated in FIG. 11, the tab portion 42 of the brace member 36 turns in an upward direction from the flat plate portion 38 so as to enable the tab portion 42 to be inserted into a slot 52 formed in one end 48 of the block member 44, when the block and brace members 44 and 36 are arranged in the assembled relationship. It is to be understood, however, that the width of the second end 42 of the brace member 36 may also be consistent with the width of the flat plate portion 38.

Referring to FIG. 10, an end view of the block member 44 is illustrated. Block member 44 is comprised of a flat plate portion 46 having first 48 and second 50 ends thereof. The first end 48 of the block member 44 turns in an upward direction to form an angle of substantially 90° with respect to the flat plate portion 46. The first end 48 of the block member 44 includes a slot 52 formed therein. The slot 52, which may be punched or cut out of the first end 48, is provided with suitable dimensions to receive the tab portion 42 of the brace member 36. The second end 50 of the block member 44 also turns in an upward direction to form an angle of substantially 90° with respect to the flat plate portion 46. The second end 50 includes a suitable number of screwholes, or the like, to enable the block member 44 to be securely connected to the outside of the mold form 4. The flat plate portion 46 may also include a number of screwholes, or the like, whereby the block member 44 can be securely connected to the casting pad 6.

When the block and brace members 44 and 36 are arranged in the assembled relationship of FIG. 11, the tap portion 42 of the brace member 36 is removably received into the slot 52 formed in the first end 48 of the block member 44, while the second end 40 of the brace member 36 is connected to the mold form 4. The second upturned end 50 of the block member 44 is fabricated with a greater height than the first upturned end 48 thereof. Hence, the block and brace assembly 54 forms a right triangle to provide maximum support to the mold form 4. That is, the second end 50 and the flat plate portion 46, which comprise the block member 44, form the sides of the right triangle. The flat plate portion 38, which comprises the brace member 36, forms the hypotenuse of the right triangle. The first upturned end 40 of the brace member 36 is connected to the mold form 4 at a point above the corresponding connection of the second upturned end 50 of the block member 44 to the mold form 4. This connection provides maximum upper and lower lateral support to the outside of the mold form 4 during the formation of a concrete panel.

FIGS. 12 and 13 show another preferred embodiment of the block and brace assembly 70 of the present invention. More particularly, FIG. 12 shows a top view of the block member 60. The block member 60 is comprised of a flat plate portion 62 having one end 64 thereof turned in an upward direction to form an angle of substantially 90° with respect to the flat plate portion 62. The upturned end 64 includes a suitable number of screwholes, or the like, to enable the block member 60 to be securely connected to the outside of the mold form 4. The flat plate portion 62 may also have a number of screwholes, or the like, whereby the block member 60 can be securely connected to the casting pad 6. Moreover, the flat plate portion 62 includes a slot 66 formed therein. The slot 66, which may be punched or cut out of the flat plate portion 62, is provided with suitable dimensions to receive one end 14 of the brace member 10, as best illustrated in FIG. 13.

FIG. 13 shows the block and brace members 60 and 10 arranged in the assembled relationship 70. The brace member 10 is similar in appearance to the brace member previously disclosed in FIG. 3, and, therefore, for convenience, the same reference characters have been applied. Although reference can be made to FIG. 3 and the disclosure relating thereto, the brace member 10 of the present embodiment is briefly described as follows. The brace member 10 is comprised of a flat plate portion having first 12 and second 14 ends thereof. The first end 12 turns in a direction upward from the flat plate portion which comprises brace member 10. The first upturned end 12 includes a suitable number of screwholes, or the like, to enable the brace member 10 to be securely connected to the outside of the mold form 4. The second end 14 of the brace member 10 may be either squared or rounded off and is removably received by the slot 66 formed in the flat plate portion 62 of the block member 60.

The block and brace assembly 70 form a right triangle to provide maximum upper and lower lateral support to the mold form 4. That is, the flat plate portion 62 and the upturned end 64, which comprise the block member 60, form the sides of the right triangle. The second end 14 of the brace member 10 forms the hypotenuse of the right triangle. The first upturned end 12 of the brace member 10 is connected to the outside of the mold form 4 at a point above the corresponding connection of the upturned end 64 of the block member 60 to the mold form 4. Lateral support for the mold form is further enhanced by virtue of the present embodiment, inasmuch as the second end 14 of the brace member 10 may contact and be opposed by the casting pad 6 via the slot 66 formed in the flat plate portion 62 of the block member 60.

Hence, any one of the presently disclosed embodiments for the block and brace assembly of the present invention may be reliably installed with less time and labor, is substantially stronger and safer, and is reusable, thereby minimizing both waste and cost with respect to the wooden block and cleat assembly of the prior art.

It will be apparent that while the preferred embodiments of the block and brace assembly have been shown and disclosed, various modifications and changes may be made without departing from the true spirit and scope of the invention. For example, although the block and brace assembly are described as having particular application in the art of tilt-up construction, the invention is not to be regarded as limited solely thereto. It is to be understood that the instant block and brace assembly has application wherever an inexpensive and efficient structural support means is required. Moreover, although an upturned end of the brace member is connected to the outside of the mold form at a point above the corresponding connection of an upturned end of the block member to the mold form, it is to be understood that the upturned ends of each of the block and brace members may be alternatively connected to the mold form at the same point. Thus, a single screw, nail, or the like, can be conveniently utilized to connect both of the block and brace members to the outside of the mold form.

Having thus set forth the preferred embodiments of the present invention, what is claimed is:

1. A block and brace member assembly to support a mold form during the formation of a present panel within said mold form, said block and brace member assembly including:

a block member comprising a plate means and first and second arms connected to respective first and second ends of said plate means, each of said arms being angled with respect to said plate means, the first angled arm of said block member adapted to be connected to said mold form, and a brace member comprising a plate means and at least a first arm connected to one of first and second ends of said brace member plate means, the first arm of said brace member being angled with respect to said brace member plate means, the first angled arm of said brace member adapted to be connected to said mold form at a point above the corresponding connection of the first angled arm of said block member to said mold form, the second end of said brace member plate means received by the second angled arm of said block member plate means.

2. The block and brace member assembly recited in claim 1, wherein the first angled arm of said block member is longer than the second angled arm thereof.

3. The block and brace member assembly recited in claim 1, wherein the first angled arm of said block member turns in an upward direction to make an angle of substantially 90° with respect to said block member plate means.

4. The block and brace member assembly recited in claim 3, wherein the second angled arm of said block member turns in an upward direction to make an angle of substantially 90° with respect to said block member plate means, the second angled arm of said block member having a slot formed therein so as to receive the second end of said brace member plate means.

5. The block and brace member assembly recited in claim 4, wherein said brace member also comprises a second arm connected to the second end of said brace member plate means, said second brace member arm being angled with respect to said brace member plate means so as to be received in the slot formed in the second angled arm of said block member.

6. The block and brace member assembly recited in claim 5, wherein the second angled arm of said brace member comprises a tab portion, said tab portion having a length and a width that is smaller in dimension than those of said brace member plate means, whereby said tab portion is received in the slot formed in the second angled arm of said block member.

7. The block and brace member assembly recited in claim 1, wherein the second angled arm of said block member turns in an upward direction to make an angle of less than 90° with respect to said block member plate means so as to receive the second end of said brace member plate means.

8. The block and brace member assembly recited in claim 1, wherein the first and second angled arms of said block member turn upwardly from said block member plate means and in substantially the same direction, the first angled arm of said block member making an angle of substantially 90° with respect to said block member plate means, and said second angled arm of said block member making an angle of less than 90° with respect to said block member plate means.

9. The block and brace member assembly recited in claim 1, wherein said block member is a portion of extruded channel means.

10. The block and brace member assembly recited in claim 1, wherein said block member plate means, said first angled arm of said block member and said brace member plate means form the sides of a right triangle when in the assembled relationship.

11. Structural support means including:

a first plate member having a base portion and respective first and second ends connected to said base portion, at least a first of said ends turned in an upward direction from said base portion to be connected to the structure to which support is to be provided, a second plate member having a base portion and respective first and second ends connected to the base portion of said second plate member, at least a first of said ends of said second plate member turned in an upward direction from the base portion of said second plate member to be connected to the structure to which support is to be provided, whereby the first upturned end of said second plate member extends above the first upturned end of said first plate member, and means by which to connect the respective second ends of each of said first and second plate members together.

12. The structural support means recited in claim 11, wherein the first upturned end of said first plate member makes an angle of substantially 90° with respect to the base portion of said first plate member, whereby the base portion of said first plate member, the first upturned end of said first plate member, and the base portion of said second plate member form a right triangle in the assembled relationship.

13. The structural support means recited in claim 11, wherein the respective second end of said first plate member has a slot formed therein, the respective second end of said second plate member to be received in the slot formed in the second end of said first plate member, whereby the respective second ends of said first and second plate members are connected to one another.

14. The structural support means recited in claim 11, wherein the respective second end of said second plate member includes an elongated pin means attached thereto.

15. The structural support means recited in claim 14, wherein the respective second end of said first plate means includes retaining means attached thereto, said retaining member means pivotably receiving the second end of said second plate member at the pin means thereof, whereby the respective second ends of said first and second plate members are connected to one another.

16. The structural support means recited in claim 15, wherein said retaining means includes a pair of sleeves having hollow portions therein, said pair of sleeves being spaced from one another on the second end of said first plate member to pivotably receive the second end of said second plate member at said elongated pin means.

17. A block and brace assembly to support a mold form, including:

a block and a brace, each comprising a plate member having respective first and second ends thereof, the first end of said block plate member turning in an upward direction to be connected to said mold form, the second end of said block plate member having hollow sleeve means attached thereto, the first end of said brace plate member turning in a upward direction to be connected to said mold form at a point above the connection of the first end of said block plate member to said mold form, and the second end of said brace plate member having an elongated pin means attached thereto, whereby said hollow sleeve means of said block pivotably engages the elongated pin means of said brace in the assembled relationship.

18. A block and brace member assembly to support a mold form, said block and brace member assembly comprising:

a block member including a plate means and first and second arms connected to respective first and second ends of said plate means, each of said arms being angled with respect to said plate means, the first angled arm of said block member to be connected to said mold form, the second angled arm of said block member having a slot formed therein, and a brace member including a plate means and first and second arms connected to respective first and second ends of said brace member plate means, each of said brace member arms being angled with respect to said brace member plate means, the first angled arm of said brace member to be connected to said mold form, the second angled arm of said brace member to be received by the slot formed in the second angled arm of said block member.

19. The block and brace assembly recited in claim 18, wherein the first angled arm of said brace member extends above the first angled arm of said block member, when in the assembled relationship with said mold form.

20. Structural support means comprising: a first plate member including a base portion, said base portion having first and second ends, at least one of said base portion ends being angled so as to be connected to the structure to which support is to be provided, the other of said base portion ends having a slot formed therein, and a second plate member including a base portion, said second plate member base portion having first and second ends, at least one of said second plate member base portion ends being angled so as to be connected to the structure to which support is to be provided, the other of said second plate member base portion ends to be received by the slot formed in the other of said first plate member base portion ends.

* * * * *